US009974987B1

(12) United States Patent
Swift

(10) Patent No.: US 9,974,987 B1
(45) Date of Patent: May 22, 2018

(54) EXTINGUISHING CONTAINER KIT FOR A FLAMMABLE SUBSTANCE

(71) Applicant: Ron Swift, Encinitas, CA (US)

(72) Inventor: Ron Swift, Encinitas, CA (US)

( * ) Notice: Subject to any disclaimer, the term of this patent is extended or adjusted under 35 U.S.C. 154(b) by 0 days. days.

(21) Appl. No.: 15/382,737

(22) Filed: Dec. 18, 2016

(51) Int. Cl.

| | |
|---|---|
| ***A62C 99/00*** | (2010.01) |
| ***A62C 3/06*** | (2006.01) |
| ***B65D 43/02*** | (2006.01) |
| ***B65D 25/28*** | (2006.01) |
| ***B65D 33/28*** | (2006.01) |
| ***B65D 47/32*** | (2006.01) |

(52) U.S. Cl.
CPC ..... *A62C 3/06* (2013.01); *A62C 99/0045* (2013.01); *B65D 25/2811* (2013.01); *B65D 33/28* (2013.01); *B65D 43/02* (2013.01); *B65D 47/32* (2013.01); *B65D 2525/283* (2013.01)

(58) Field of Classification Search
CPC ..... A62C 3/06; A62C 99/0045; B65D 2519/00865
USPC ..... 169/45
See application file for complete search history.

(56) References Cited

U.S. PATENT DOCUMENTS 290,238 A * 12/1883 Johns ..... A47G 27/0256 112/412
652,331 A * 6/1900 Rudolph ..... B65F 1/0006 206/459.5
1,717,396 A 6/1929 Minzoff
2,062,618 A 12/1936 Sterling
3,443,745 A * 5/1969 Kleeberg ..... B65F 1/06 232/43.2
5,711,423 A * 1/1998 Fuller, Jr. ..... A24F 15/18 206/246
6,422,413 B1 * 7/2002 Hall ..... B65D 90/028 220/4.12
6,644,217 B1 * 11/2003 Meyer ..... B65D 71/0096 108/51.11
D629,605 S * 12/2010 Traiger ..... D3/234
8,833,625 B2 * 9/2014 Giard ..... A45F 3/04 224/656
9,469,440 B1 * 10/2016 Flood ..... B65D 33/00
2005/0082305 A1 * 4/2005 Dais ..... B65D 43/021 220/785
2007/0235510 A1 * 10/2007 Werthmann ..... F24B 15/04 229/122.1
2008/0191001 A1 * 8/2008 Chandaria ..... B32B 3/28 229/100

(Continued)

FOREIGN PATENT DOCUMENTS

JP 2402488 A1 1/2012

*Primary Examiner* — Alexander Valvis
*Assistant Examiner* — Viet Le

(57) ABSTRACT

An extinguishing container kit including a resilient, foldable fireproof cloth having an original extended condition for holding the flammable substance therein. The resiliency of the fireproof cloth permits return to the original extended condition when released from an alternate cinched condition in which a fireproof drawstring woven through the apertures is gathered to cinch the fireproof cloth. An impermeable, fireproof container holds the cinched fireproof cloth, the flammable substance stored therein, and an optional amount of water. A removable lid is disposed on the fireproof container to seal the fireproof container to limit air ingress thereinto to extinguish and cool the flammable substance for subsequent disposal or re-use.

1 Claim, 4 Drawing Sheets

(56) References Cited

U.S. PATENT DOCUMENTS

| | | | | |
|---|---|---|---|---|
| 2008/0290094 | A1* | 11/2008 | Bruce | A45C 3/001 220/560.01 |
| 2008/0296189 | A1* | 12/2008 | Walters | A45C 11/00 206/424 |
| 2009/0218249 | A1* | 9/2009 | Stalter | B32B 21/13 206/524.2 |
| 2010/0071327 | A1* | 3/2010 | Alexander | B01D 39/1615 55/514 |
| 2010/0089918 | A1* | 4/2010 | Logan | B65D 81/107 220/62.15 |
| 2012/0012493 | A1* | 1/2012 | Cleveland | B65D 21/0223 206/508 |
| 2012/0042442 | A1* | 2/2012 | Takahashi | D03D 13/008 2/458 |
| 2012/0048852 | A1* | 3/2012 | Knote | A62C 3/00 220/88.1 |
| 2013/0161331 | A1* | 6/2013 | Pherson | B65D 88/14 220/560.01 |
| 2015/0122815 | A1* | 5/2015 | Musciano | B32B 5/26 220/200 |
| 2015/0144640 | A1* | 5/2015 | Kaya | B65D 88/14 220/560.01 |
| 2015/0313403 | A1* | 11/2015 | Park | A47J 36/06 220/573.1 |
| 2017/0096295 | A1* | 4/2017 | Pherson | B64D 9/00 |
| 2017/0113861 | A1* | 4/2017 | Olszewski | B65D 81/02 |
| 2017/0146191 | A1* | 5/2017 | Gehlhausen | F17C 3/04 |
| 2017/0166394 | A1* | 6/2017 | Baylay | B65D 90/22 |
| 2017/0197392 | A1* | 7/2017 | Illeperuma | B32B 27/12 |
| 2017/0237054 | A1* | 8/2017 | Mast | B65D 25/02 320/107 |

* cited by examiner

EXTINGUISHING CONTAINER KIT FOR A FLAMMABLE SUBSTANCE

BACKGROUND OF THE INVENTION

Various types of fireproof bags and tongs for handling flammable substances, such as burning barbecue briquettes, are known in the prior art. What is needed, and what the present device provides, is a reusable extinguishing container kit for a flammable substance, such as charcoal briquettes commonly used in a barbecue grill or other similar flammable materials, to safely, effectively, and efficiently both ignite and capture the flammable substance, to extinguish the flammable substance by eliminating oxygen from the burning process without fear of catching another object on fire, and then dispose of or re-use the flammable substance once extinguished and cooled.

FIELD OF THE INVENTION

The present invention relates to devices used for handling flammable substances, and more particularly, to an extinguishing container kit for a flammable substance.

SUMMARY OF THE INVENTION

The general purpose of the present extinguishing container kit for a flammable substance, described subsequently in greater detail, is to provide an extinguishing container kit for a flammable substance that has many novel features that result in an extinguishing container kit for a flammable substance that is not anticipated, rendered obvious, suggested, or even implied by prior art, either alone or in combination thereof.

To accomplish this, the present extinguishing container kit for a flammable substance is devised to ignite, handle and extinguish a flammable substance. An example of such a substance would be charcoal briquettes commonly used in a barbecue grill. The kit is composed mainly of a fireproof cloth and container as described more fully below.

The extinguishing container kit for a flammable substance includes a resilient, flexible, foldable, fireproof cloth capable of holding the flammable substance. It has a top surface and a bottom surface. Near the outer edge of the cloth is a plurality or series of reinforced apertures. A suitable flexible, fireproof drawstring is woven or threaded through the apertures alternately. After threading all the holes, the loose ends of the drawstring are sufficiently long enough to allow them to be placed in a cool area during use of the device.

The fireproof cloth has an extended condition and an alternate cinched condition. The extended condition allows the cloth to be placed on a surface with the drawstring relaxed, allowing the cloth to take the shape of the surface. The cinched condition is obtained when the drawstring ends are pulled. This pulls the cloth into the cinched position, forming a pocket. The ends of the drawstring now extend from the cloth and are suitable for picking up the cinched cloth and its contents.

For ignition, typically the cloth will be placed in its appropriate position for use, such as in a barbecue grill basin, either extended or cinched and then extended. This exposes any flammable substance saved for reuse or allows new flammable substance to be placed on top of the cloth. The substance can be ignited as appropriate. Alternately, the cloth can be placed as appropriate and the already ignited material can be placed on top.

After the flammable substance has performed it's function, the cloth can be cinched by pulling the drawstrings ends, drawing the fireproof cloth into the cinched position with the flammable material inside. Using the drawstring, the cinched cloth containing the flammable material can be moved as appropriate.

An impermeable, fireproof container is provided to hold the fireproof cloth in the cinched condition along with the flammable substance therein and an optional amount of water or other vapor producing substance. A removable lid seals the fireproof container to limit air ingress in order to extinguish the flammable substance once it uses up the oxygen in the container. At least one suitable handle is disposed on the lid and container. A vent hole is disposed within the lid to permit the release of gases. Once the flammable substance is extinguished, the lid can be removed, and the cinched cloth with the flammable substance within can be removed from the container. The fireproof cloth, being resilient and flexible, can be returned to its original extended condition when the drawstring is relaxed by pulling the cloth edges and exposing the flammable substance. The flammable substance can be disposed or re-used.

Thus has been broadly outlined the more important features of the present extinguishing container kit for a flammable substance so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
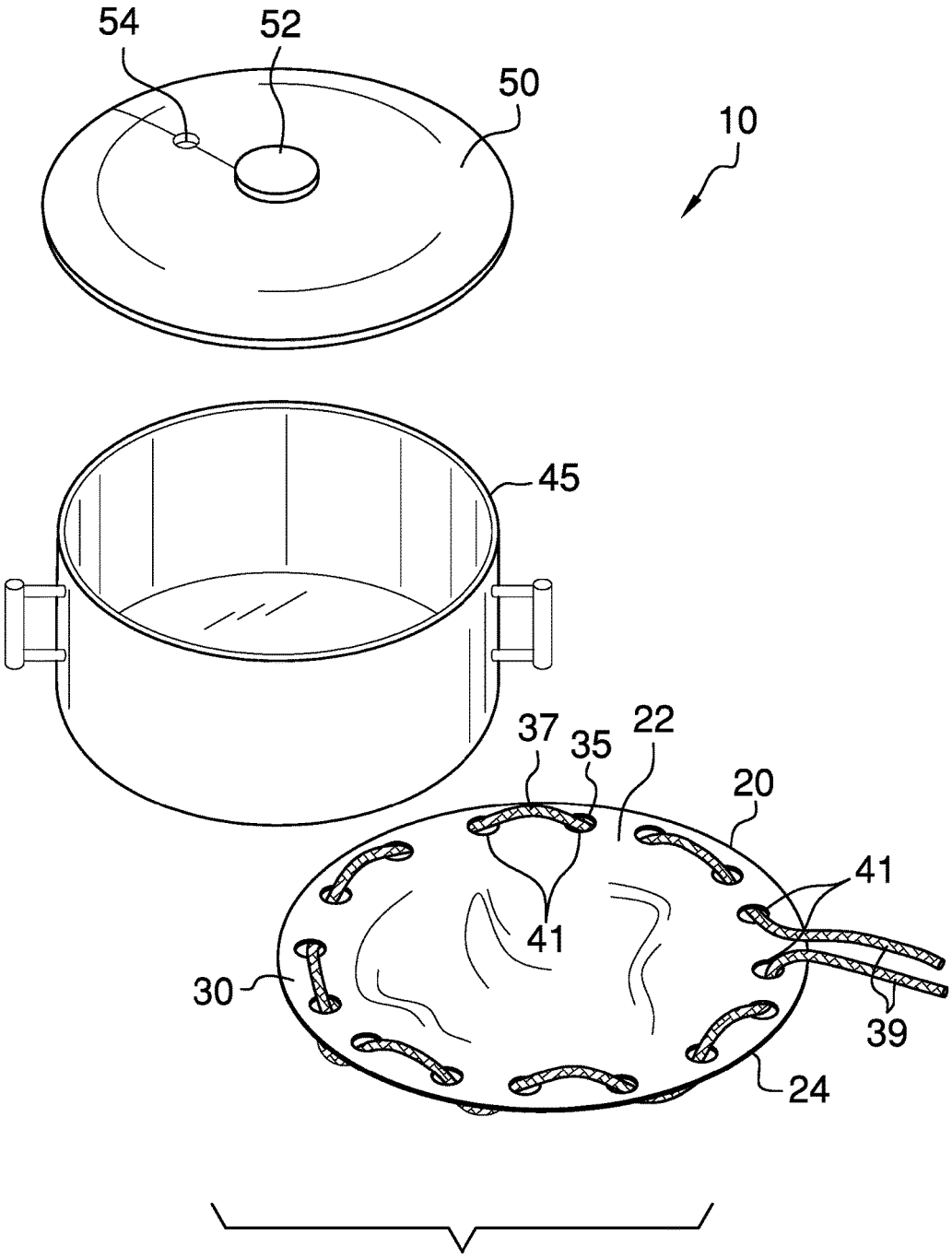
FIG. 1 is an exploded view of a fireproof cloth in an original extended condition, a resilient impermeable fireproof container, and a lid for the container.
Figure 2:
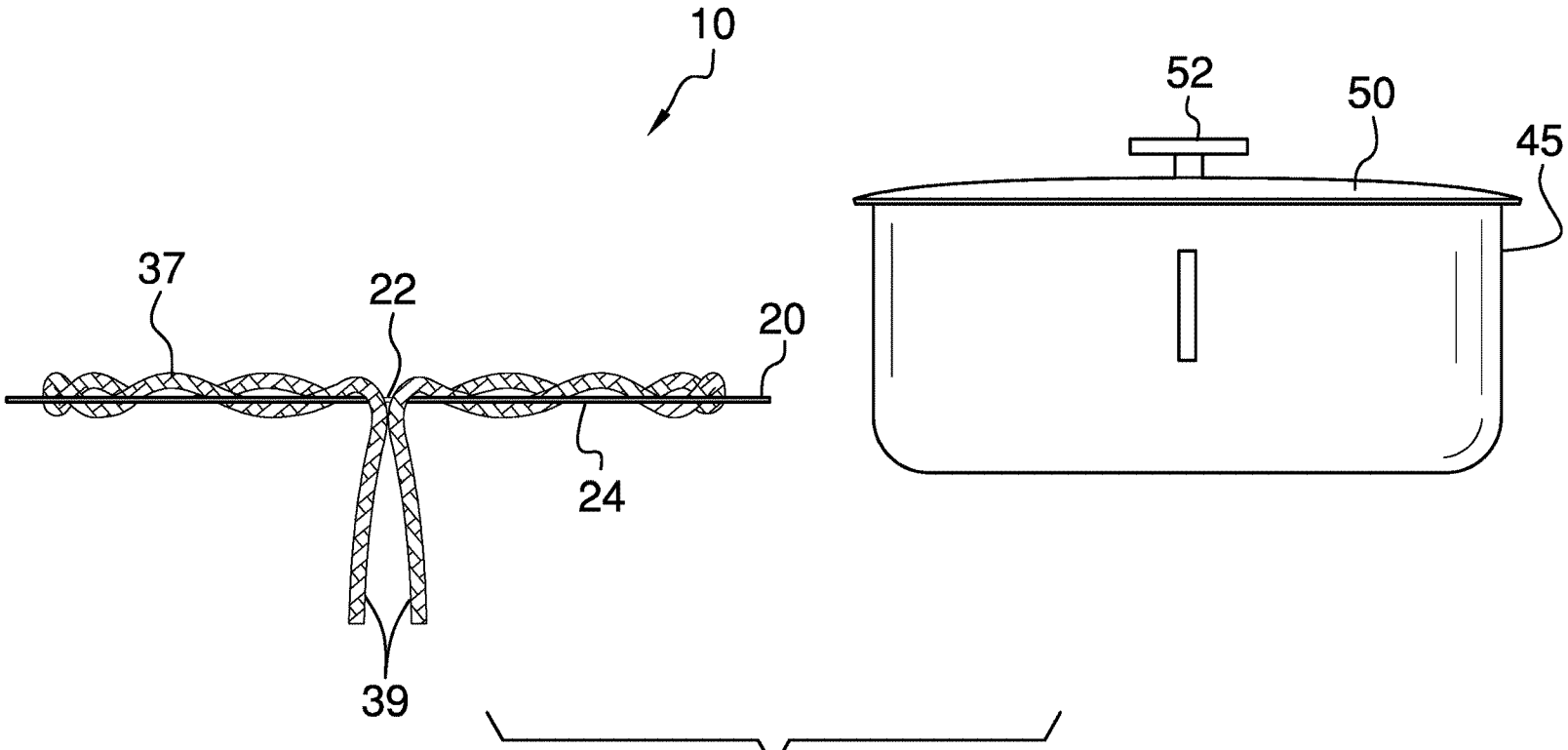
FIG. 2 is a front elevation view of the fireproof cloth in the original extended condition and the container with the lid disposed thereon.
Figure 3:
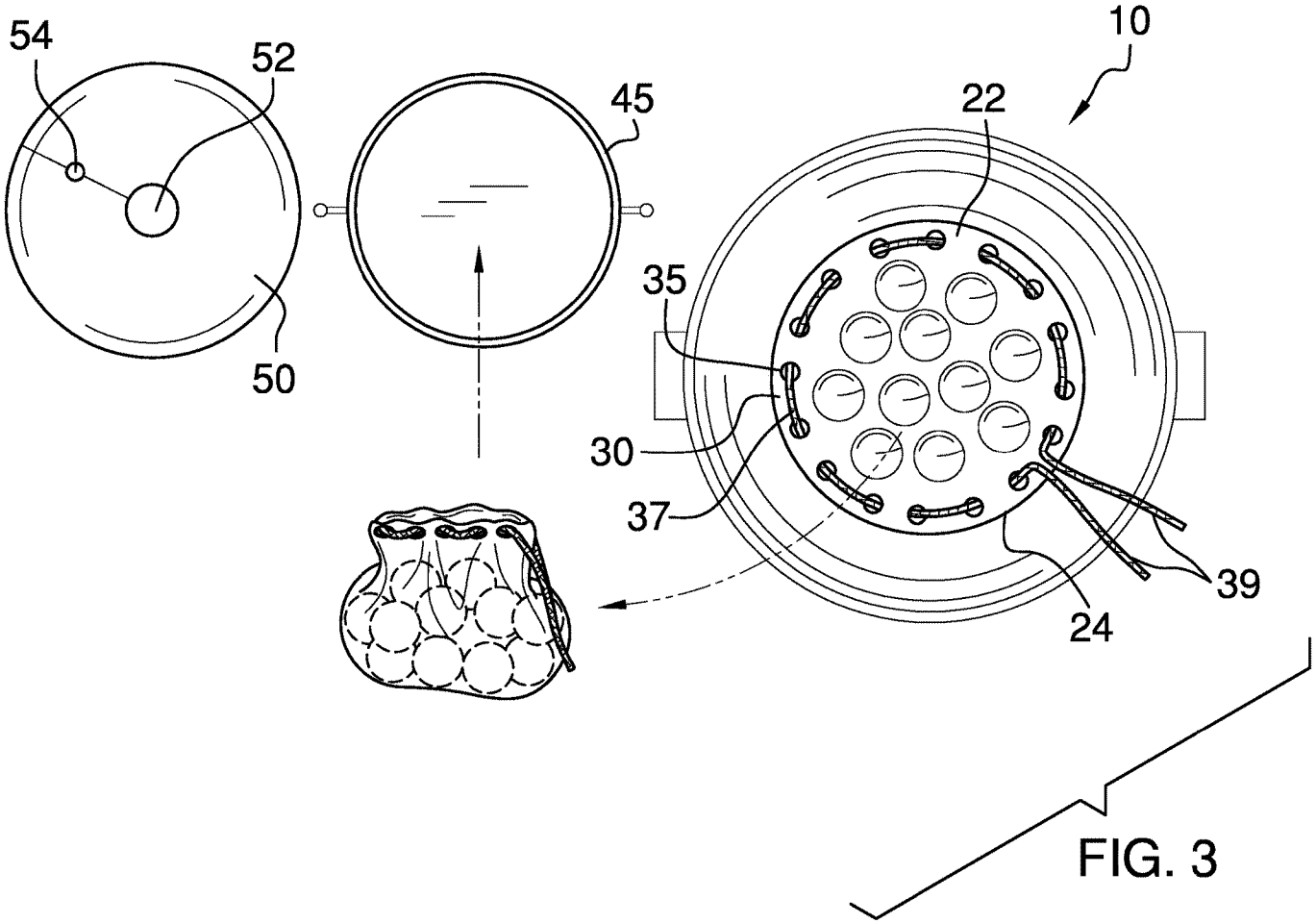
FIG. 3 is an in-use top plan view showing the fireproof cloth disposed in the extended condition and located, for example, in a barbecue grill basin, with the flammable substance in the form of charcoal briquettes disposed on top of the cloth. After use, the fireproof cloth can be cinched by pulling the drawstrings, converting the cloth to the cinched position with the flammable substance within and placed in the container and the lid disposed on the container. The flammable substance will extinguish when all the oxygen is consumed.
Figure 4:
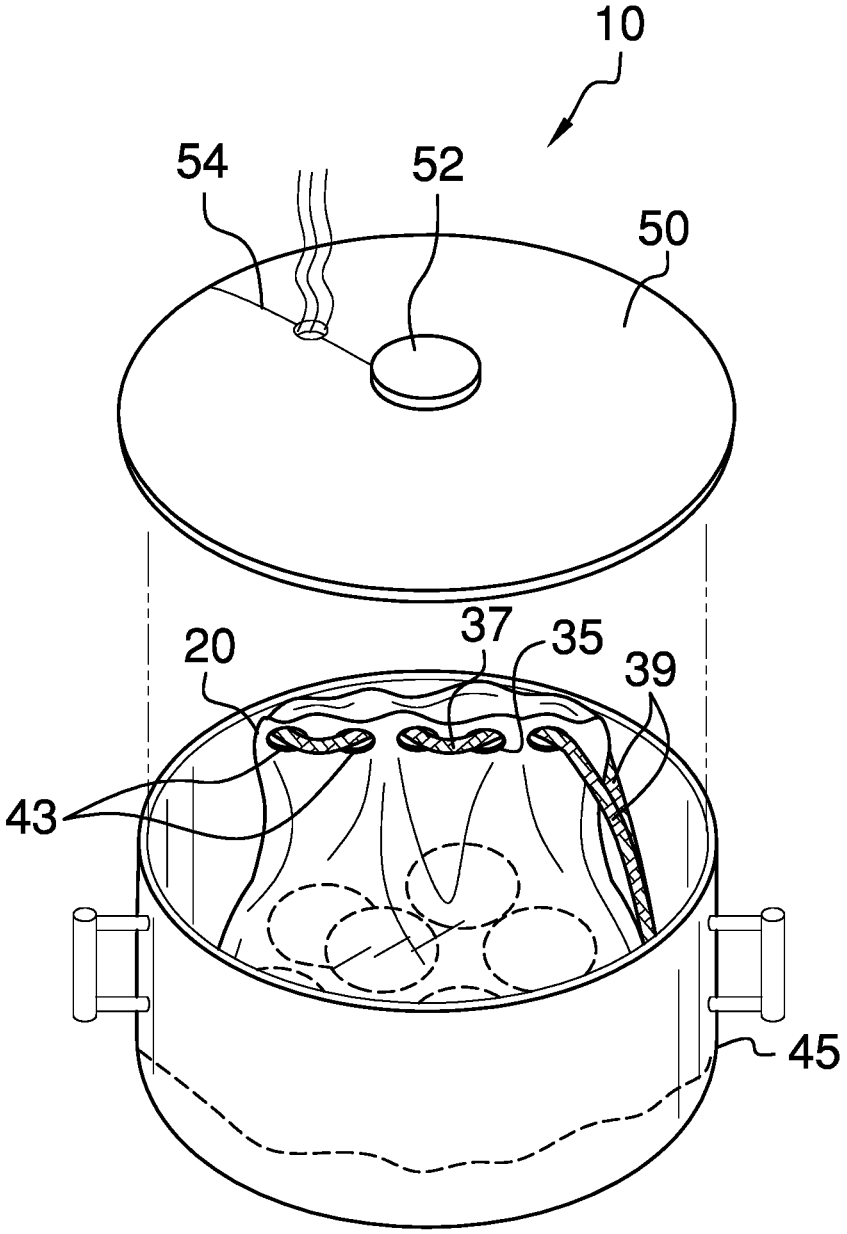
FIG. 4 is an isometric view showing the fireproof cloth in an alternate cinched condition disposed within a container, the flammable substance disposed within the fireproof cloth holder, and a lid sealable onto the container.

With reference now to the drawings, and in particular FIGS. 1 through 4 thereof, an example of the extinguishing container kit for a flammable substance employing the principles and concepts of the present extinguishing container kit for a flammable substance and generally designated by the reference number 10 will be described.

Referring to FIGS. 1 through 4, the present extinguishing container kit for a flammable substance 10 devised to handle and extinguish a flammable substance, such as ignited charcoal briquettes commonly used in a barbecue grill, is illustrated. The extinguishing container kit for a flammable substance 10 includes a resilient, foldable fireproof cloth 20. The fireproof cloth 20 has a top surface 22 and a bottom surface 24. The fireproof cloth 20 has an original extended condition and an alternate cinched condition. The fireproof cloth 20 can subsequently be transformed from the original extended condition into the cinched condition and back.

A plurality of apertures 35 is continuously disposed around an outer perimeter 30. A fireproof drawstring 37 is woven through the plurality of apertures 35 and has a pair of external ends 39, which extend from an adjacent pair of apertures 41 of the plurality of apertures 35. As shown in FIG. 1, the plurality of apertures is arranged as needed. The drawstring 37 is configured to cinch the outer perimeter 30 of the fireproof cloth 20 to transform the fireproof cloth 20 from the original extended condition into the alternate cinched condition.

An impermeable, fireproof container 45 is provided to hold the fireproof cloth 20 in the cinched condition along with the flammable substance stored therein and an optional amount of water. The container 45 has one or two handles as appropriate. A removable lid 50 is disposed on the fireproof container 45 to seal the fireproof container 45. The removable lid 50 seals the fireproof container 45 to limit air ingress thereinto in order to self extinguish the flammable substance. At least one heat resistant handle 52 is disposed on the lid 50. A vent hole 54 is disposed within the lid 50 to permit the release of gases from the container 45 as the amount of water evaporates from the container 45 as the amount of water evaporates from the container 45. Once extinguished, the flammable substance can be removed from the container 45 for disposal or re-use.

What is claimed is:

1. An extinguishing container kit for holding a flammable substance comprising:

a resilient foldable fireproof cloth;

the resilient foldable fireproof cloth comprising a top surface, a bottom surface, an outer periphery, a plurality of apertures and a fireproof drawstring;

the resilient foldable fireproof cloth being selectively in an extended condition and a cinched condition;

the resilient foldable fireproof cloth being configured to hold the flammable substance thereon in response to the resilient foldable fireproof cloth being in the extended condition;

the resilient foldable fireproof cloth being configured to hold the flammable substance therein in response to the resilient foldable fireproof cloth being in the cinched condition;

the resilient foldable fireproof cloth being of plate-shaped in response to the resilient foldable fireproof cloth being in the extended condition;

the resilient foldable fireproof cloth being of bag-shaped in response to the resilient foldable fireproof cloth being in the cinched condition;

the top surface and the bottom surface being located opposite to each other;

the outer periphery being perimetrically formed on the top surface and the bottom surface;

the plurality of apertures penetrating the top surface and the bottom surface;

the plurality of apertures being arranged on the outer periphery;

the plurality of apertures being separate from each other;

the fireproof drawstring being woven through the plurality of apertures;

the fireproof drawstring comprising two external ends;

the two external ends extending from two adjacent apertures among the plurality of apertures;

the resilient foldable fireproof cloth being in the extended condition in response to the fireproof drawstring not cinching the outer periphery;

the resilient foldable fireproof cloth being in the cinched condition in response to the fireproof drawstring cinching the outer periphery;

the resilient foldable fireproof cloth being capable of transforming from being of plate-shaped into being of bag-shaped by pulling the two external ends away from the two adjacent apertures among the plurality of apertures;

the resilient foldable fireproof cloth being capable of transforming from being of bag-shaped into being of plate-shaped by relaxing the two external ends towards the two adjacent apertures among the plurality of apertures;

an impermeable fireproof container;

the resilient foldable fireproof cloth being removably accommodated within the impermeable fireproof container;

the impermeable fireproof container being configured to store the flammable substance and a predetermined amount of water therein;

a removable lid;

the removable lid being removably disposed on the impermeable fireproof container;

the impermeable fireproof container comprising a first heat resistant handle; and the removable lid comprising a second heat resistant handle and a vent hole.

* * * * *